US007752796B2

(12) United States Patent
Ramsey, Sr.

(10) Patent No.: US 7,752,796 B2
(45) Date of Patent: Jul. 13, 2010

(54) LOCKING DEVICE FOR FIREARM

(75) Inventor: Donald Bruce Ramsey, Sr., Litchfield, OH (US)

(73) Assignee: Barrel Gunlock, LLC, Litchfield, OH (US)

( * ) Notice: Subject to any disclaimer, the term of this patent is extended or adjusted under 35 U.S.C. 154(b) by 220 days.

(21) Appl. No.: 11/510,908

(22) Filed: Aug. 28, 2006

(65) Prior Publication Data

US 2008/0047187 A1 Feb. 28, 2008

(51) Int. Cl.
*F41A 17/00* (2006.01)

(52) U.S. Cl. ..... 42/70.11; 42/70.01; 42/66

(58) Field of Classification Search ..... 42/70.11, 42/70.04, 70.08, 66, 70.01
See application file for complete search history.

(56) References Cited

U.S. PATENT DOCUMENTS

| | | | | |
|---|---|---|---|---|
| 2,836,918 | A | 6/1958 | Pula et al. | |
| 2,887,807 | A | 5/1959 | Santangelo | |
| 4,224,753 | A | 9/1980 | Bielman | |
| 4,398,366 | A | 8/1983 | Wernicki | |
| 4,479,320 | A | 10/1984 | Fix | |
| 4,512,099 | A | 4/1985 | Mathew | |
| 4,783,924 | A | 11/1988 | Thurber | |
| 4,908,971 | A | 3/1990 | Chaney | |
| 5,048,211 | A | 9/1991 | Hepp | |
| 5,138,785 | A | 8/1992 | Paterson | |
| 5,241,770 | A | 9/1993 | Lambert | |
| 5,289,653 | A | 3/1994 | Szebeni et al. | |
| 5,398,438 | A | 3/1995 | Williams | |
| 5,488,794 | A | 2/1996 | Arrequin | |
| 5,664,358 | A | 9/1997 | Haber et al. | |
| 5,918,403 | A | 7/1999 | Lurz, Jr. et al. | |
| 5,950,344 | A | 9/1999 | Ross | |
| 6,212,813 | B1 | 4/2001 | Luna et al. | |
| 6,405,472 | B1 | 6/2002 | Dojesak | |
| 6,408,556 | B1 * | 6/2002 | Achee et al. | 42/70.11 |
| 6,578,308 | B2 | 6/2003 | Hickerson | |
| 2002/0092223 | A1 * | 7/2002 | Blomquist et al. | 42/70.11 |
| 2004/0025394 | A1 * | 2/2004 | Young | 42/70.11 |
| 2004/0200114 | A1 | 10/2004 | Milo | |

OTHER PUBLICATIONS

Omega™ , The Internal Gunlock Solution, Omega Safety Systems—Product Line, reprinted from the Internet at http://www.omegagunlock.com/sutopistols.htm, Apr. 26, 2006, 6 pgs.

* cited by examiner

*Primary Examiner*—J. Woodrow Eldred
*Assistant Examiner*—Gabriel J Klein
(74) *Attorney, Agent, or Firm*—Eschweiler & Associates, LLC

(57) ABSTRACT

A device and method for locking a firearm are provided, the device having a locking round, elongate locking rod, protective cylinder, and locking tool. The locking round has a radial flange, an internal thread, and a plurality of prongs associated therewith, wherein the prongs are disposed about a circumference of the locking round. The locking rod has a conical cam, an external thread, and a first engagement member, wherein the cam is operable to radially expand the prongs through engagement between the internal and external threads. A removable tool having a second engagement member is operable to be inserted into the protective cylinder that is rotatably coupled to the locking rod, wherein a rotation of the tool is operable to operable to engage the shoulder, prongs, and protective cylinder with the firearm, thus providing first, second, and third friction regions for locking the locking device in the firearm.

20 Claims, 4 Drawing Sheets

LOCKING DEVICE FOR FIREARM

FIELD OF THE INVENTION

The present invention relates generally to a safety lock for a firearm and a method for locking a firearm to selectively prevent firing thereof.

BACKGROUND OF THE INVENTION

In today's society, ownership of firearms quite common. When in the immediate possession of a responsible and qualified owner, a firearm can be used safely and properly for a multitude of purposes, such as for security or protection, hunting, sports such as skeet, trap, and target shooting, and even for collection or display. When stored unlocked, or in the possession of a unauthorized, unintended, or careless person, however, the firearm can pose a significant threat to the safety of the public, and even to the person, themselves. For example, a loaded firearm that has been carelessly left unlocked in a location such that a child could reach and handle the firearm can have catastrophic consequences. Accordingly, a variety of firearm locks have been introduced in an attempt to limit the threat of live firearms falling into the wrong hands.

A large number of firearm locks have taken the form of various trigger locks, wherein the trigger is either blocked from translating, thus preventing unintended firing of the firearm. Other locks have taken the form of barrel or chamber locks, wherein either the barrel of the firearm is blocked by a locking device inserted therein, or the firing chamber is prevented from loading a round of ammunition, in combination with the barrel being blocked. Conventionally, such locking devices have extended from the end of the barrel, wherein the locking device is clearly visible by a casual observer, and wherein a key or other tool is needed to remove the locking device from the end of the barrel. Such locking devices, however, are not well suited for displayed collections of firearms, where the viewer of the collection may wish to admire the firearms as they would appear in his or her hand and about to fire, and without an obstructive locking device extending from the barrel.

Thus, it is desirable to provide device for safely locking a firearm, wherein the firearm can be displayed without the locking device being noticed by a casual observer.

SUMMARY OF THE INVENTION

The present invention overcomes the limitations of the prior art by providing device for safely locking a firearm. Accordingly, the following presents a simplified summary of the invention in order to provide a basic understanding of some aspects of the invention. This summary is not an extensive overview of the invention. It is intended to neither identify key or critical elements of the invention nor delineate the scope of the invention. Its purpose is to present some concepts of the invention in a simplified form as a prelude to the more detailed description that is presented later.

The present invention is directed generally toward a locking device for a firearm, and more particularly, to a locking device that is substantially visually undetectable while providing a great degree of safety and security. In accordance with one exemplary aspect of the invention, a locking device is provided, wherein the locking device comprises a generally cylindrical locking round operable to be chambered into a firing chamber of the firearm. The locking round comprises a flange extending radially outward from a first end of the locking round, wherein the flange is operable to engage a shoulder of a firing chamber of the firearm, therein providing a first friction region associated with the locking device.

According to another aspect of the invention, the locking round comprises a plurality of prongs separated by a plurality of radially-spaced slits, through an internal axial bore that extends from the second end of the locking round toward the first end of the locking round. In one example, the plurality of prongs extend to an intermediate region between the first and second ends of the locking round, wherein a radius of the internal axial bore generally decreases from the second end of the locking round toward the intermediate region, therein generally defining a bevel in the plurality of prongs.

An elongate locking rod having a first end and a second end is further provided, wherein the locking rod comprises a generally conical cam associated with the first end thereof. The cam is generally defined by a first radius and a second radius, wherein the first radius is smaller than the second radius, and wherein an external thread generally extends axially from the first radius of the cam to the first end of the locking rod. The external thread of the locking rod is operable to threadingly engage an internal thread of the locking round, wherein the internal thread generally extends axially into the locking round from the intermediate region toward the first end of the locking round. The threaded engagement between the locking rod and the locking round generally forces the cam against the bevel in the plurality of prongs, therein forcing the plurality of prongs against an interior wall of the firing chamber. The engagement between the prongs and the interior wall of the firing chamber thus provides a second friction region between the locking device and the firearm.

A first engagement member is further associated with the second end of the locking rod, wherein a generally hollow protective cylinder encircles the first engagement member. The protective cylinder has a first end and a second end, the first end of the protective cylinder is rotatably coupled to the locking rod proximate to the second end of the locking rod, and wherein the second end of the protective cylinder comprises a generally hollow and conical flare extending radially outward. The conical flare is operable to selectively engage an internal portion of a muzzle of the firearm, therein generally defining a third friction region between the locking device and the firearm.

A removable tool comprising a shaft having first end and a second end is further provided, wherein the first end of the shaft comprises a second engagement member operable to be inserted into the protective cylinder and is configured to selectively mate with the first engagement member. An axial rotation of the tool is further operable rotate and linearly translate the cam based on the engagement between the internal thread and external thread, therein increasing an amount of friction in the first, second, and third friction regions. The increased friction thus locks the locking device with respect to the firearm, thus generally preventing a firing of the firearm, while providing an appearance of an unlocked firearm to the casual observer.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
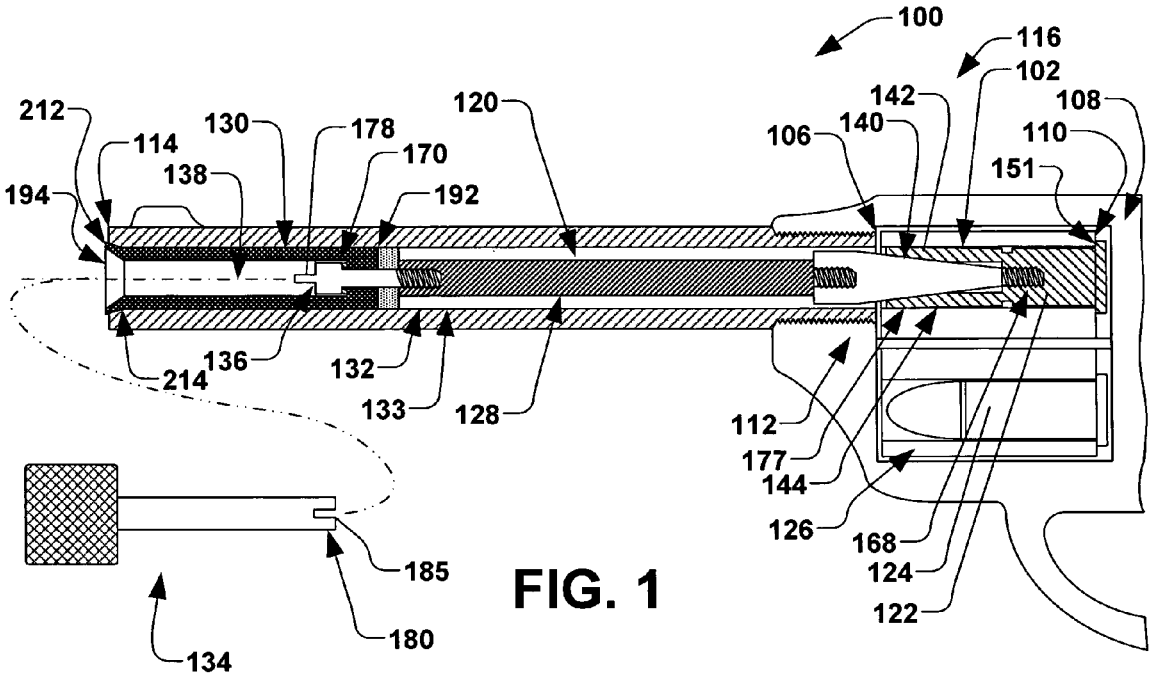
FIG. 1 illustrates a partial view of an exemplary firearm having a locking device inserted therein in accordance with one aspect of the present invention.

The present invention is directed generally toward a locking device for a firearm. Accordingly, the present invention will now be described with reference to the drawings, wherein like reference numerals may be used to refer to like elements throughout. It should be understood that the description of these aspects are merely illustrative and that they should not be interpreted in a limiting sense. In the following description, for purposes of explanation, numerous specific details are set forth in order to provide a thorough understanding of the present invention. It will be evident to one skilled in the art, however, that the present invention may be practiced without these specific details.

Referring now to the figures, FIG. 1 illustrates a partial view of an exemplary firearm 100, wherein several aspects of the present invention will now be discussed. The firearm 100 of the present example comprises a firing chamber 102 and an elongate barrel 104, wherein the firing chamber comprises a firing end 106 facing the barrel and a generally opposite loading end 108 having a shoulder 110 associated therewith. The barrel 104, for example, comprises a first end 112 facing the firing chamber 102 and a generally opposite muzzle end 114. In the present example, the firearm 100 comprises a revolver-type handgun 116, however, it will be understood that the firearm may alternatively comprise any number of different types of firearm, such as a semi-automatic, revolver or other type of handgun, rifle, shotgun, or various other types of firearm, and all such firearms are contemplated as falling within the scope of the present invention.

Figure 2:
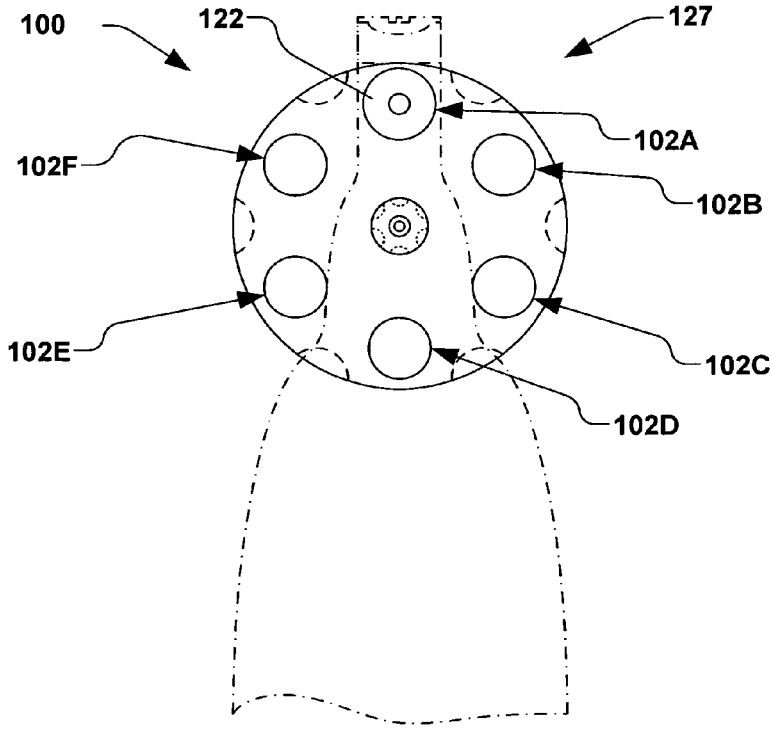
FIG. 2 illustrates an end-view of the exemplary firearm of FIG. 1 according to another aspect of the invention.

In accordance with one exemplary aspect of the present invention, a locking device 120 is provided, wherein the locking device is operable to selectively disable the firearm 100. According to the present invention, the locking device 120 comprises a generally cylindrical locking round 122, wherein the locking round is operable to be chambered into the firing chamber 102 of the firearm 100. For example, the locking round 122 is operable to be chambered in a manner similar to a chambering of a ballistic round or bullet 124 (e.g., shown in a rotational cylinder 126 of the firearm 100). It should be noted that the locking round 122 may be chambered into the firing chamber with or without the presence of one or more ballistic rounds 124 in the rotational cylinder 126, or as in the case of a semi-automatic firearm, a clip (not shown). FIG. 2 illustrates an end view 127 of the exemplary firearm 100, wherein the locking round 122 is chambered in the firing chamber 102A. It should be noted locking round 122 of the present invention need only be chambered in a single firing chamber 102, thus leaving the remaining firing chambers 102B-102F to be left empty or to be chambered with live ammunition (not shown).

According to the present invention, the locking device 120 of FIG. 1 further comprises an elongate locking rod 128 operable to be inserted into the muzzle end 114 of the firearm 100, wherein the locking rod is further operable to engage the locking round 122. The locking device 120 further comprises a generally hollow protective cylinder 130 operably coupled to the locking rod 128, wherein an internal portion 132 (e.g., inner surface 133) of the barrel 104 is generally protected by the protective cylinder, as will be further described in more detail infra. The locking device 120 still further comprises a removable tool 134 operable to selectively engage a first engagement member 136 associated with the locking rod 128. Accordingly, upon a general rotation of the tool 134 (and thus, the locking rod 128) about an axis 138 of the barrel 104, a cam 140 associated with the locking rod is operable to engage a plurality of prongs 142 associated with the locking round 122, therein generally expanding the prongs radially against an internal surface 144 (e.g., a "bore") of the firing chamber 102. The locking round 122, locking rod 128, and protective cylinder 130 are thus selectively operable to be locked with respect to the barrel 104 and firing chamber 102 of the firearm 100, therein generally preventing a firing of the firearm, as will now be described in more detail.

Figure 3:
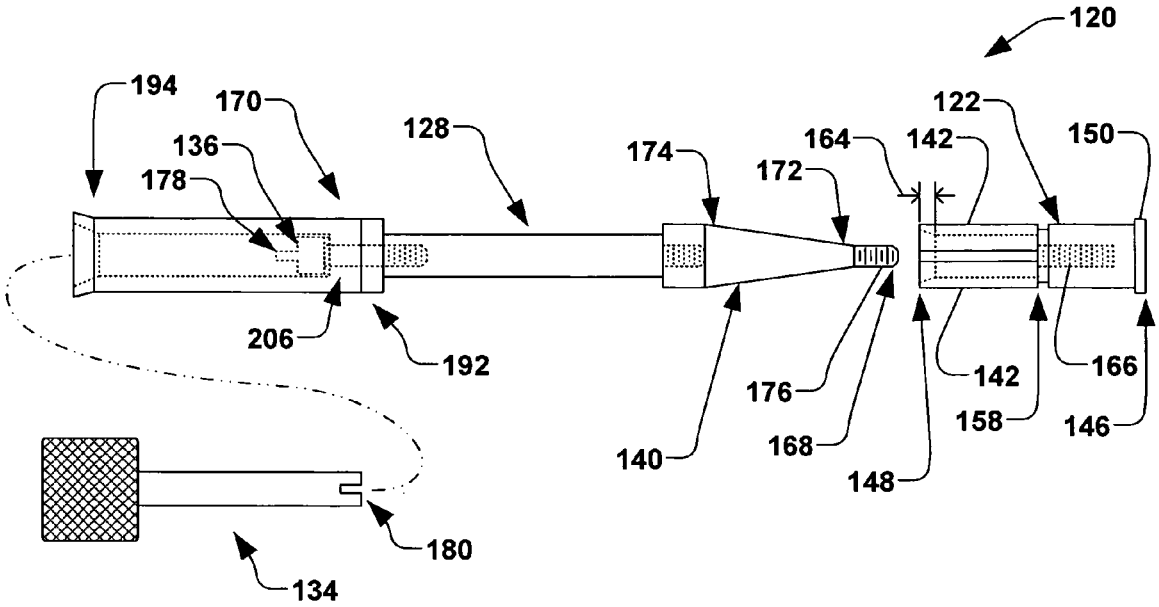
FIG. 3 illustrates a locking device according to yet another exemplary aspect of the present invention.

In order to gain a better understanding of the present invention, the locking device 120 of FIG. 1 is illustrated being removed from the firearm 100 in FIG. 3, wherein several inventive aspects of the invention will now be described. As illustrated in FIG. 3, the exemplary locking round 122 has a first end 146 and a second end 148, wherein the first end generally comprises a flange 150 extending radially outward therefrom, and wherein the flange is operable to engage the shoulder 110 of the firing chamber 102 of FIG. 1, therein providing a first friction region 151 between the locking device 120 and the firearm 100.

FIG. 3 illustrates a perspective view from the second end 148 of the exemplary locking round 122, wherein the flange 150 generally extends radially outward from a circumferential surface 152 of the first end 146 of locking round 122. An internal axial bore 154 generally extends into the locking round 122 from the second end 148 thereof, wherein a plurality of slits 156 are further radially spaced about the circumferential surface 152 of the locking round, therein generally defining the plurality of prongs 142. As illustrated in FIG. 2, the plurality of slits 156 generally extend from the second end 148 of the locking round 122 to an intermediate region 158 thereof, wherein the plurality of prongs 142 are generally cantilevered from the intermediate region of the locking round toward the second end. In one example, three or more prongs 142 are equally spaced about the circumferential surface 152 of the locking round 122, however, any number of prongs and spacing are contemplated as falling within the scope of the present invention.

Figure 4:
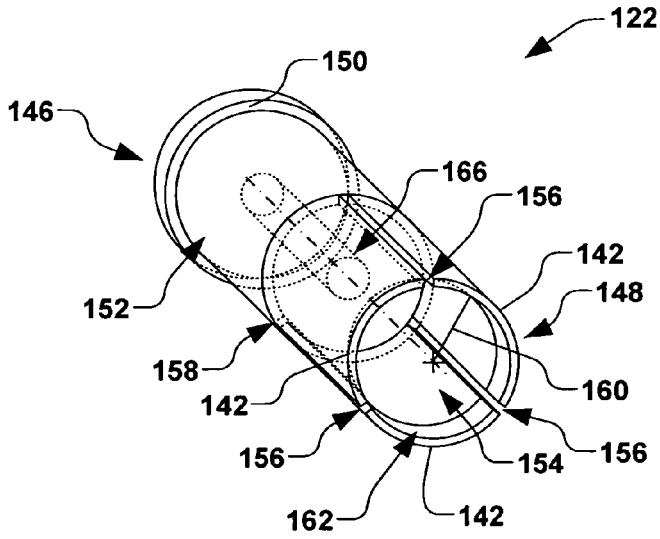
FIG. 4 is a perspective view of an exemplary locking round according to the present invention.

In accordance with one exemplary aspect of the invention, a radius 160 of the internal axial bore 154 generally decreases from the second end 148 of the locking round toward the intermediate region 158 thereof, therein generally defining a bevel 162 in the plurality of prongs 142. The bevel 162, for example, may extend from the second end 148 to the intermediate region 158 of the locking round, or, alternatively, the bevel may extend into the locking round by a predetermined distance 164 from the second end thereof, as illustrated in FIG. 3, therein generally facilitating an engagement with the cam 140 with the locking round 122, as will be described hereafter. The locking round 122 illustrated in FIGS. 3 and 4 further comprises an internal thread 166 (e.g., a female thread) extending axially from the intermediate region 158 toward the first end 146 of the locking round. The internal thread 166, for example, may extend from the intermediate region 158 to the first end 146 of the locking round 122, as illustrated in FIG. 4, or the internal thread may alternatively be a blind thread as illustrated in FIG. 3, extending only partially toward the first end 146 of the locking round.

The locking round 122, for example, is comprised of a material having a having a hardness of less than Rockwell B28, wherein the locking round will generally not damage or deform the internal surface 144 of the firing chamber 102 illustrated in FIG. 1 upon contact thereto. The present invention contemplates the firing chamber 102 of the firearm being comprised of hardened steel or the like, wherein the locking round 122 is comprised of brass or a similar metal or material, thus providing the locking round as being significantly softer than the firing chamber, and thus generally preventing damage to the internal surface 144 of the firing chamber 102.

According to another aspect of the present invention, the elongate locking rod 128 illustrated in FIG. 3 has a first end 168 and a second end 170 associated therewith. The cam 140, for example, is associated with the first end 168 of the locking rod 128, wherein the cam is generally conical in shape and is generally defined by a first radius 172 and a second radius 174, wherein the first radius is smaller than the second radius. The first radius 172 of the cam 140, for example is further smaller than the radius 160 of the internal axial bore 154 of the locking round 122 of FIG. 4, while the second radius 174 of the cam is larger than the radius of the internal axial bore of the locking round. The radius of the bevel 162 in the prongs 142 of the locking round 122, for example, is further larger than the first radius 172 of the cam 140, but smaller than the second radius 174 of the cam.

The locking rod 128 further comprises an external thread 176 (e.g., a male thread) extending axially from the first radius 172 of the cam 140 to the first end 168 of the locking rod, wherein the external thread is operable to threadingly engage and mate with the internal thread 166 of the locking round 122. Accordingly, a rotation of the locking rod 128 with respect to the locking round 122 is operable to generally rotate and linearly translate the cam 140 with respect to the locking round via the threaded engagement between the external thread 176 and internal thread 166. Thus, the cam 140 is operable to expand the plurality of prongs 142 outwardly, thus engaging the prongs with the internal surface 144 of the barrel 104 of the firearm 100 of FIG. 1. The engagement between the plurality of prongs 142 and the barrel 104 thus provides a second friction region 177 between the locking device 120 and the firearm 100.

Figure 5:
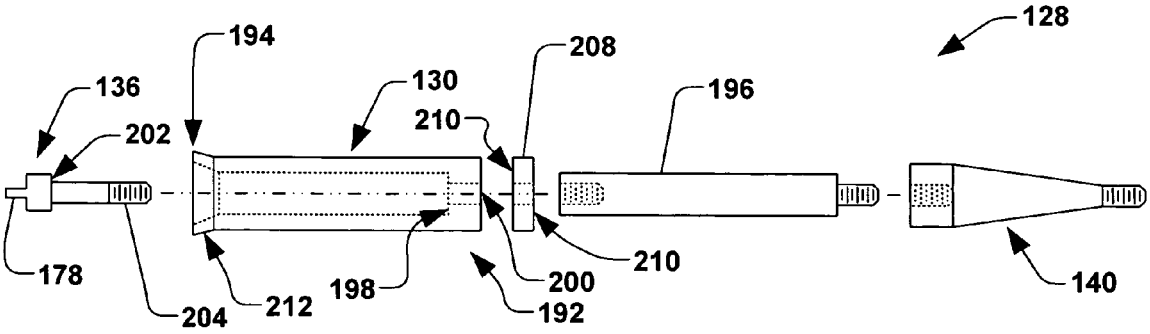
FIG. 5 illustrates an exemplary locking rod and protective cylinder in accordance with the present invention.
Figure 6:
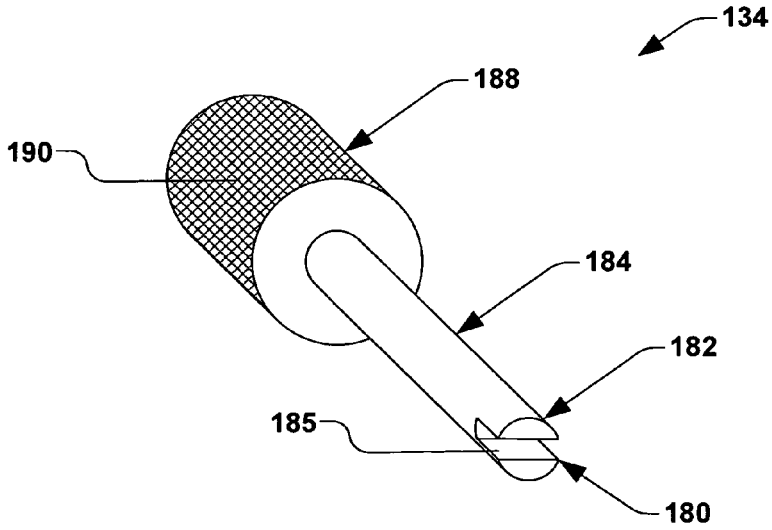
FIG. 6 is a perspective view of an exemplary locking tool in accordance with the present invention.

Referring again to FIG. 3, the first engagement member 136 of the locking rod 128 is associated with the second end 170 the locking rod, wherein the first engagement member comprises a diametric flange 178 generally extending from the second end of the locking rod. FIG. 5 illustrates the locking rod 128 and protective cylinder 130 in further detail in a blown-up view. The diametric flange 178, for example, is designed such that the locking rod 128 generally cannot be rotated with a conventional screwdriver when inserted into the barrel 104 of FIG. 1, but rather, generally requires a mating second engagement member 180 associated with the removable tool 134 to engage the diametric flange in order to thread or unthread the locking rod with respect to the locking round 122. For example, the removable tool 134 is illustrated in FIG. 6, wherein the second engagement member 180 is associated with a first end 182 of a shaft 184 of the tool, wherein the second engagement member comprises a diametric slot 185 extending into the first end of the shaft. Alternatively, the first and second engagement members 136 and 180 illustrated in FIGS. 1 and 3 may take a variety of different mating shapes or configurations, wherein a "tamper-proof" characteristic of the engagement members is provided. A second end 186 of the shaft 184, as illustrated in FIG. 6, for example, further comprises a handling member 188, such as a knurled cylinder 190, wherein a user of the locking device can grip the gripping member for easy rotation of the tool 134.

In accordance with another aspect of the invention, the generally hollow protective cylinder 130, as illustrated in FIG. 3 for example, further comprises a first end 192 and a second end 194, wherein the first end of the protective cylinder is rotatably coupled to the locking rod 128 proximate to the second end 170 of the locking rod. For example, as can be understood via the blown-up view of FIG. 5, the first engagement member 136 is threadingly coupled to an extension rod 196 of the locking rod 128, wherein the first engagement member rotatably couples the protective cylinder 130 to the extension rod. In the present example, the first end 192 of the protective cylinder 130 comprises an internal flange 198 extending radially inward to a thru-hole 200, and the second end 170 of the locking rod 128 (e.g., the first engagement member 136) comprises a shoulder 202 extending radially outward therefrom. The first engagement member 136 is thus coupled to the extension rod 196 (e.g., via threaded rod 204), wherein the protective cylinder 130 is generally rotatably coupled to the locking rod via an interface 206 (e.g., illustrated in FIG. 3) between the internal flange 198 of the protective cylinder of FIG. 5 and the shoulder 202 of the extension rod. A collar 208 may be further interposed between the protective cylinder 130 and the locking rod extension rod 196, wherein the collar generally acts as a radial bearing surface 210 between the extension rod and the protective cylinder.

Accordingly, the protective cylinder 130 generally protects the internal portion 132 of the barrel 104 of the firearm 100 of FIG. 1 when inserting the locking tool 134 into the protective cylinder to engage the first and second engagement members 136 and 180. The protective cylinder 130, for example, is comprised of a material having a hardness of less than Rockwell D785, wherein the protective cylinder will generally not damage or deform the internal portion 132 of the barrel 104 upon contact thereto. For example, the internal portion 132 of the barrel 104 comprises precision-machined rifling grooves (not shown), wherein the protective cylinder 130 generally protects the grooves from damage or deformation. In the present example, the present invention contemplates the barrel being comprised of hardened steel, wherein the protective cylinder is comprised of polymer or metal having a hardness that is less than hardened steel.

According to another exemplary aspect of the invention, the second end 194 of the protective cylinder 130 illustrated in FIGS. 1, 3, and 5 further comprises a generally hollow and conical flare 212 extending radially outward therefrom, wherein the conical flare is further operable to selectively engage at least the internal portion 132 of the firearm 100 of FIG. 1 at the muzzle end 114 thereof. Thus, conical flare 212 of the hollow cylinder 130 generally provides a third friction region 214 between the locking device 120 and the firearm 100. For example, the diameter of the second end 194 of the protective cylinder 130 (e.g., the largest diameter of the conical flare 212) is approximately five percent larger than the diameter of the first end 192 of the protective cylinder, therein providing an interference fit with the barrel 104 of the firearm 100 of FIG. 1. The conical flare 212 may extend from the first end 192 to the second end 194 of the protective cylinder 130, or, alternatively, the conical flare may have an axial length of approximately 5 millimeters or less, wherein the flare is operable to protrude less than approximately 2 millimeters from the muzzle end 114 of the firearm 100 when inserted therein. Accordingly, the protective cylinder 130 can protrude from the muzzle end 114 of the firearm 100, thus providing a degree of shock-absorbency, should the firearm be dropped such that the muzzle end should impact the ground. For example, the protective cylinder 130 can protect a crown and precision machined grooving (not shown) associated with the barrel 104 of the firearm 110.

Figure 7:
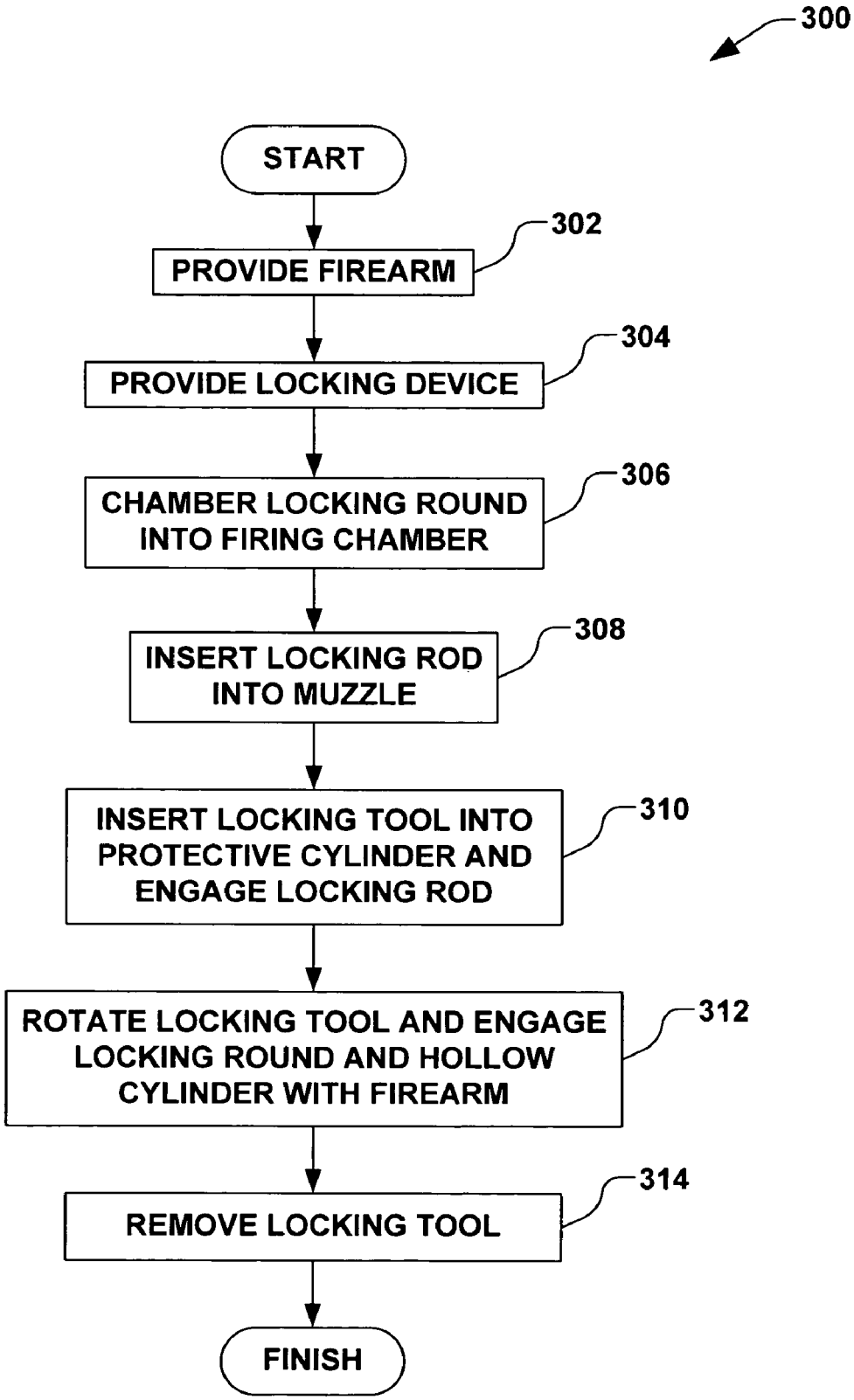
FIG. 7 is a block diagram of an exemplary method for locking a firearm according to another aspect of the invention.

In accordance with still another aspect of the present invention, a method 300 for locking a firearm is provided in FIG. 7. While exemplary methods are illustrated and described herein as a series of acts or events, it will be appreciated that the present invention is not limited by the illustrated ordering of such acts or events, as some steps may occur in different orders and/or concurrently with other steps apart from that shown and described herein, in accordance with the invention. In addition, not all illustrated steps may be required to implement a methodology in accordance with the present invention. Moreover, it will be appreciated that the methods may be implemented in association with the systems illustrated and described herein as well as in association with other systems not illustrated.

As illustrated in FIG. 7, the method 300 begins with act 302, wherein a firearm is provided. The firearm, for example, comprises a firing chamber and an elongate barrel, wherein the firing chamber has a firing end facing the barrel and a generally opposite loading end having a shoulder associated therewith. The barrel further comprises a first end facing the firing chamber and a generally opposite muzzle end. In act 304, a locking device is provided, such as the locking device 120 of FIGS. 1 and 3. The locking device generally comprises a locking round, a locking rod, a generally hollow protective cylinder, and a locking tool. In act 306, the locking round is chambered into the loading end of the firing chamber, wherein a flange of the locking round engages the shoulder of the firing chamber, therein providing a first friction region between the locking device and the firearm.

In act 308, a first end of the locking rod is inserted into the muzzle end of the barrel until the locking rod engages the locking round (e.g., via a threaded engagement). In act 310, the locking tool is inserted into the muzzle end of the barrel and through the protective cylinder, wherein a second engagement member of the locking tool rotatably engages a first engagement member of the locking rod. The locking tool is then rotated with respect to the barrel in act 312 (e.g., less than six full rotations), wherein the locking rod threads into the locking round, therein forcing a conical cam of the locking device against a plurality of prongs of the locking round. The plurality of prongs are thus forced against an interior wall of the firing chamber, therein generally fixing the locking round with respect to the firing chamber and providing a second friction region. Further, the rotation of act 312 further engages a conical flare of the protective cylinder with an interior portion of the muzzle end of the barrel, therein providing a third friction region, wherein the first, second, and third friction regions generally inhibit a rotation of the locking round with respect to the firing chamber during the rotation of the locking rod, and wherein the rotation of the locking tool generally locks the firearm from being fired. The locking tool may then be removed from the barrel in act 314, wherein the firearm remains locked after the removal of the locking tool. Once the locking tool is removed, the firearm can be displayed, wherein the locking device is substantially undetectable, visually.

Accordingly, the present invention provides a locking device and method for locking a firearm, wherein the locking device is nearly imperceptible to a casual viewer when the firearm is locked. Further, the locking device of the present invention advantageously provides three friction regions for locking the firearm, wherein spinning of the locking round is substantially minimized, and wherein the locking device provides multiple engagement locations with the firearm. It should be noted that although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A locking device for a firearm, the locking device comprising:

a generally cylindrical locking round operable to be chambered into a firing chamber of the firearm, the locking round comprising:

a flange extending radially outward from a first end of the locking round, wherein the flange is operable to engage a shoulder of a firing chamber of the firearm;

a plurality of prongs generally defined by:

an internal axial bore extending from the second end of the locking round toward the first end thereof to an intermediate point defined along an axial length of the locking round between the first end and second end, wherein a radius of the internal axial bore uniformly decreases from the second end of the locking round to the intermediate point, therein generally defining a bevel in the plurality of prongs, and a plurality of slits radially spaced about the locking round, the plurality of slits generally extending from the second end of the locking round to the intermediate point, wherein the plurality of slits terminate at the intermediate point; and an internal thread extending axially from the intermediate point toward the first end of the locking round;

an elongate locking rod having a first end and a second end, the locking rod comprising:

a generally conical cam associated with the first end of the locking rod, the cam being defined by a first radius and a second radius, wherein the first radius is smaller than the second radius;

an external thread extending axially from the first radius of the cam to the first end of the locking rod, wherein the external thread is operable to threadingly engage the internal thread of the locking round; and a first engagement member associated with the second end of the locking rod, wherein an axial rotation of the first engagement member is operable rotate and linearly translate the cam based on an engagement between the internal thread and external thread, therein radially translating the plurality of prongs and selectively engaging the plurality of prongs with a bore of the firing chamber; and a generally hollow protective cylinder having a first end and a second end, wherein the first end of the protective cylinder is rotatably coupled to the locking rod proximate to the second end of the locking rod, wherein the first engagement member is generally encircled by the protective cylinder, and wherein the second end of the protective cylinder has a generally hollow and conical flare extending radially outward therefrom, wherein the conical flare is operable to selectively engage an internal portion of a muzzle of the firearm.

2. The locking device of claim 1, wherein the protective cylinder is comprised of a material having a hardness of less than Rockwell D785.

3. The locking device of claim 2, wherein the protective cylinder is comprised of a polymer material.

4. The locking device of claim 1, comprising three prongs equally spaced about a circumference of the locking round.

5. The locking device of claim 1, wherein the locking round is comprised of a material having a hardness of less than Rockwell B28.

6. The locking device of claim 5, wherein the locking round is comprised of brass.

7. The locking device of claim 1, further comprising a removable tool comprising a shaft having first end and a second end, wherein the first end of the shaft comprises a second engagement member operable to be inserted into the protective cylinder, wherein the second engagement member is configured to selectively mate with the first engagement member, and wherein the second end of the shaft comprises a handling member.

8. The locking device of claim 7, wherein the first engagement member comprises a diametric flange extending from the second end of the locking rod, and wherein the second engagement member comprises a diametric slot extending into the first end of the shaft.

9. The locking device of claim 1, wherein the first end of the protective cylinder comprises an internal flange extending radially inward, and wherein the second end of the locking rod comprises a shoulder extending radially outward therefrom, wherein the protective cylinder is generally rotatably coupled to the locking rod via an interface between the internal flange of the protective cylinder and the shoulder of the locking rod.

10. The locking device of claim 1, wherein the plurality of prongs comprise of a plurality of cantilevered members generally extending from the intermediate point to the second end of the locking round.

11. The locking device of claim 1, wherein a diameter of the second end of the protective cylinder is approximately five percent larger than a diameter of the first end of the protective cylinder.

12. The locking device of claim 1, wherein an axial length of the flare is less than approximately 5 millimeters, wherein the flare is operable to protrude less than approximately 2 millimeters from the muzzle of the firearm when inserted therein.

13. A locking device for a firearm, the locking device comprising:

a generally cylindrical locking round operable to be chambered into a firing chamber of the firearm, the locking round comprising:

a flange extending radially outward from a first end of the locking round, wherein the flange is operable to engage a shoulder of a firing chamber of the firearm;

a plurality of prongs generally defined by:

an internal axial bore extending from the second end of the locking round toward the first end thereof to an intermediate point defined along an axial length of the locking round between the first end and second end, wherein a radius of the internal axial bore uniformly decreases from the second end of the locking round to the intermediate point, therein defining a bevel in the plurality of prongs extending from the second end of the locking round to the intermediate point, and a plurality of slits radially spaced about the locking round, the plurality of slits extending from the second end of the locking round to the intermediate point, wherein the plurality of slits terminate at the intermediate point; and an internal thread extending axially from the intermediate point toward the first end of the locking round;

an elongate locking rod having a first end and a second end, the locking rod comprising:

a generally conical cam associated with the first end of the locking rod, the cam being defined by a first radius and a second radius, wherein the first radius is smaller than the second radius;

an external thread extending axially from the first radius of the cam to the first end of the locking rod, wherein the external thread is operable to threadingly engage the internal thread of the locking round; and a first engagement member associated with the second end of the locking rod, wherein an axial rotation of the first engagement member is operable rotate and linearly translate the cam based on an engagement between the internal thread and external thread, therein radially translating the plurality of prongs and selectively engaging the plurality of prongs with a bore of the firing chamber; and a generally hollow protective cylinder having a first end and a second end, wherein the first end of the protective cylinder is rotatably coupled to the locking rod proximate to the second end of the locking rod, wherein the first engagement member is generally encircled by the protective cylinder, and wherein the second end of the protective cylinder has a generally hollow and conical flare extending radially outward therefrom, wherein the conical flare is operable to selectively engage an internal portion of a muzzle of the firearm.

14. A locking device for a firearm, the locking device comprising:

a generally cylindrical locking round operable to be chambered into a firing chamber of the firearm, the locking round comprising:

a flange extending radially outward from a first end of the locking round, wherein the flange is operable to engage a shoulder of a firing chamber of the firearm;

a plurality of prongs generally defined by:

an internal axial bore extending from the second end of the locking round toward the first end thereof to an intermediate point defined along an axial length of the locking round, wherein a radius of the internal axial bore uniformly decreases from the second end of the locking round to the intermediate point, therein defining a bevel in the plurality of prongs extending from the second end of the locking round to the intermediate point, and a plurality of slits radially spaced about a circumferential surface of the locking round, the plurality of slits extending from the second end of the locking round to the intermediate point, therein cantilevering the plurality of prongs from the intermediate point; and an internal thread extending axially from the intermediate point toward the first end of the locking round;

an elongate locking rod having a first end and a second end, the locking rod comprising:

a generally conical cam associated with the first end of the locking rod, the cam being defined by a first radius and a second radius, wherein the first radius is smaller than the second radius;

an external thread extending axially from the first radius of the cam to the first end of the locking rod, wherein the external thread is operable to threadingly engage the internal thread of the locking round; and a first engagement member associated with the second end of the locking rod, wherein an axial rotation of the first engagement member is operable rotate and linearly translate the cam based on an engagement between the internal thread and external thread, therein radially translating the plurality of prongs and selectively engaging the plurality of prongs with a bore of the firing chamber; and a generally hollow protective cylinder having a first end and a second end, wherein the first end of the protective cylinder is rotatably coupled to the locking rod proximate to the second end of the locking rod, wherein the first engagement member is generally encircled by the protective cylinder, and wherein the second end of the protective cylinder has a generally hollow and conical flare extending radially outward therefrom, wherein the conical flare is operable to selectively engage an internal portion of a muzzle of the firearm.

15. The locking device of claim 14, further comprising a removable tool comprising a shaft having first end and a second end, wherein the first end of the shaft comprises a second engagement member operable to be inserted into the protective cylinder, wherein the second engagement member is configured to selectively mate with the first engagement member, and wherein the second end of the shaft comprises a handling member.

16. The locking device of claim 15, wherein the first engagement member comprises a diametric flange extending from the second end of the locking rod, and wherein the second engagement member comprises a diametric slot extending into the first end of the shaft.

17. The locking device of claim 14, wherein the first end of the protective cylinder comprises an internal flange extending radially inward, and wherein the second end of the locking rod comprises a shoulder extending radially outward therefrom, wherein the protective cylinder is generally rotatably coupled to the locking rod via an interface between the internal flange of the protective cylinder and the shoulder of the locking rod.

18. The locking device of claim 1, wherein the internal thread extends from the intermediate point to the first end of the locking round.

19. The locking device of claim 13, wherein the plurality of prongs comprise of a plurality of cantilevered members generally extending from the intermediate point to the second end of the locking round.

20. The locking device of claim 13, wherein the internal thread defines a blind thread extending from the intermediate point partially toward the first end of the locking round.

* * * * *